US007543626B1

(12) United States Patent
Pinkstock et al.

(10) Patent No.: US 7,543,626 B1
(45) Date of Patent: Jun. 9, 2009

(54) MOLDING APPARATUS AND METHOD

(75) Inventors: Steven R. Pinkstock, Amanda, OH (US); Craig A. Holman, Newark, OH (US); John C. Concitis, Columbus, OH (US); Ronald A. Poe, Columbus, OH (US)

(73) Assignee: Columbus Steel Castings Company, Columbus, OH (US)

( * ) Notice: Subject to any disclaimer, the term of this patent is extended or adjusted under 35 U.S.C. 154(b) by 575 days.

(21) Appl. No.: 11/383,122

(22) Filed: May 12, 2006

(51) Int. Cl.
*B22C 9/20* (2006.01)
*B22C 21/00* (2006.01)

(52) U.S. Cl. ..... 164/29; 164/322; 164/374

(58) Field of Classification Search ..... 164/29, 164/129, 322, 374
See application file for complete search history.

(56) References Cited

U.S. PATENT DOCUMENTS 6,342,543 B1 1/2002 Moy et al.
6,923,239 B2 8/2005 Cagle et al.

*Primary Examiner*—Kuang Lin
(74) *Attorney, Agent, or Firm*—Standley Law Group LLP

(57) ABSTRACT

This invention teaches an improved method and apparatus to make metal alloy castings, such as railroad car connector knuckles. One embodiment of the invention comprises a plurality of core mold assembly units contained within a single molding flask, wherein the mold units are filled with molten metal by way of a common runner and riser system. The said core mold assembly elements may be further comprised of a mold and core assembly formed of the same material, such as phenolic urethane impregnated sand, which is used to accurately replicate the desired shape of a final desired product. This invention eliminates the need to carefully gauge a plurality of part patterns within a single mold flask and reduces the potential for loss of parts, for example by cold shunting, by segregating each part to its own mold isolated mold unit. Such a method and apparatus allows a plurality of parts to be cast in a more accurate way, producing less scrap, improving part dimensional stability, and in some cases, reducing the number of cores needed.

24 Claims, 11 Drawing Sheets

MOLDING APPARATUS AND METHOD

BACKGROUND AND SUMMARY OF THE INVENTION

The present invention relates generally to methods and apparatus for use in casting, particularly to more efficiently producing castings of such items as railroad car connector knuckles.

Casting methods currently used to produce items of metal alloys employ molding techniques that replicate the interior and exterior features of a desired part. Such methods comprise an exterior mold that replicates the external surface features of the desired part, while a core or cores are used to replicate interior cavities and surfaces if such parts embody hollow or reentrant features. The mold and cores are produced from a pattern of the part and are assembled together within containers called "flasks" to produce a cavity that replicates the volume and surface features of the desired part. The mold flask is usually split into two separate components; an upper component traditionally called the "cope" and a lower component called the "drag." A pattern of the part is placed within the cope and drag over which green molding sand is rammed to replicate the shape of the pattern. The cope and drag are configured to mate with each other to form two halves of the mold cavity to allow the removal of the part pattern from the compacted green sand leaving the desired mold cavity. Cores are subsequently placed within the mold and the mold halves fitted together to form a mold assembly. A system of sprues, runners, gates and risers embodied within the core mold assembly provide the requisite channels to direct molten metal poured into the formed part cavity to reproduce the part. Molten metal is poured into the mold assembly and is allowed to cool and solidify. Once the casting has cooled sufficiently, the cast part is shaken from the sand mold and the cores removed leaving the desired replicated part. The mold and core sand are usually reclaimed and reused.

Of the various types of molding methods used, molds made from "green sand" are the most widely used. Green sand is made from a pliable mixture of sand, clay, and water that coheres and can be molded in such a fashion as to faithfully replicate surface features of the part pattern shape. However, significant disadvantages are associated with the green sand method, some of which are the need for careful handling of the mold assembly due to the relative fragility of the green sand, as well as undesirable dimensional variations between castings associated with mold cavity and core misalignment and pattern wear. Additionally, green sand molding techniques typically employ core sand compositions which differ from molding sand making reclamation of these components difficult in that they are mixed during the part removal process and thus can cross-contaminate each other. Furthermore, multiple parts are typically cast at one time by using a plurality of part patterns to form several mold cavities within a single flask using a system of common runners. Such an arrangement increases the possibility of a number of parts scrapped due to core mold assembly misalignments and cold-shunting. What is needed is an improved casting apparatus and method to overcome these and other drawbacks.

The present invention disclosed herein addresses traditional shortcomings of green sand molding by employing a variation on the phenolic urethane cold-box system to produce stronger molds and cores of higher dimensional accuracy. Although other core and mold making methods may be embodied within this invention, the cold-box system employs molding sand impregnated with phenolic urethane "no-bake" (hence "cold-box") binders typically used to form molding cores. One principal advantage of using a phenolic urethane binder is that it can be rapidly catalyzed at room temperature by means of an amine vapor that is blown through the core sand to produce durable cores. Removal of the core from the cast part is made easier by carefully controlling the composition of the phenolic urethane impregnated sand and curing conditions. This invention extends the use of the cold-box system to include forming the mold as well as the core resulting in a sturdy core mold assembly that has superior dimensional stability as well as improved structural integrity that permits more aggressive handling of the mold components as compared to the need to more carefully handle molding assemblies that use a relatively fragile green sand. Furthermore, this approach reduces the likelihood of misalignments in a core mold assembly and improves the finish of the cast part, consequently reducing finishing costs and part scrap rate. Depending on the part geometry, this invention also may reduce the number of needed cores used to produce a cast part. In contrast to multiple-part green sand molding methods, this invention also may be employed to form individual or modular core mold assembly units used to form individual parts. This invention also teaches a method of embodying a plurality of such modular core mold assembly units within a single external flask assembly using a system of gates and runners to produce multiple but separate parts at one pouring, eliminating the possibility of multiple part defects associated with mold misalignment of integrated parts in one core mold assembly and thereby isolating such defects to individual core mold modules and reducing potential part scrap rates.

DETAILED DESCRIPTION OF EXEMPLARY EMBODIMENT(S)

Figure 1:
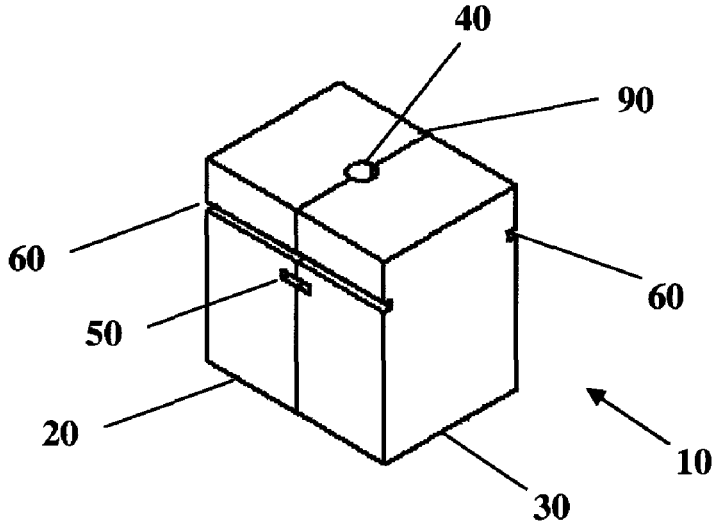
FIG. 1 is a perspective view of one exemplary embodiment of the present invention illustrating a core mold assembly unit.

The present invention is directed to casting technology. In addition, the present invention teaches a core mold assembly unit apparatus as well as a method of embodying a plurality of core mold assembly units within an external cope and external drag flask assembly to produce a plurality of independently formed parts. FIG. 1 shows an example of a core mold assembly unit 10, which comprises a core mold left half 20, a core mold right half 30, a riser vent 40, a filling gate 50, a handling groove or grooves 60, and split line 90.

Figure 2:
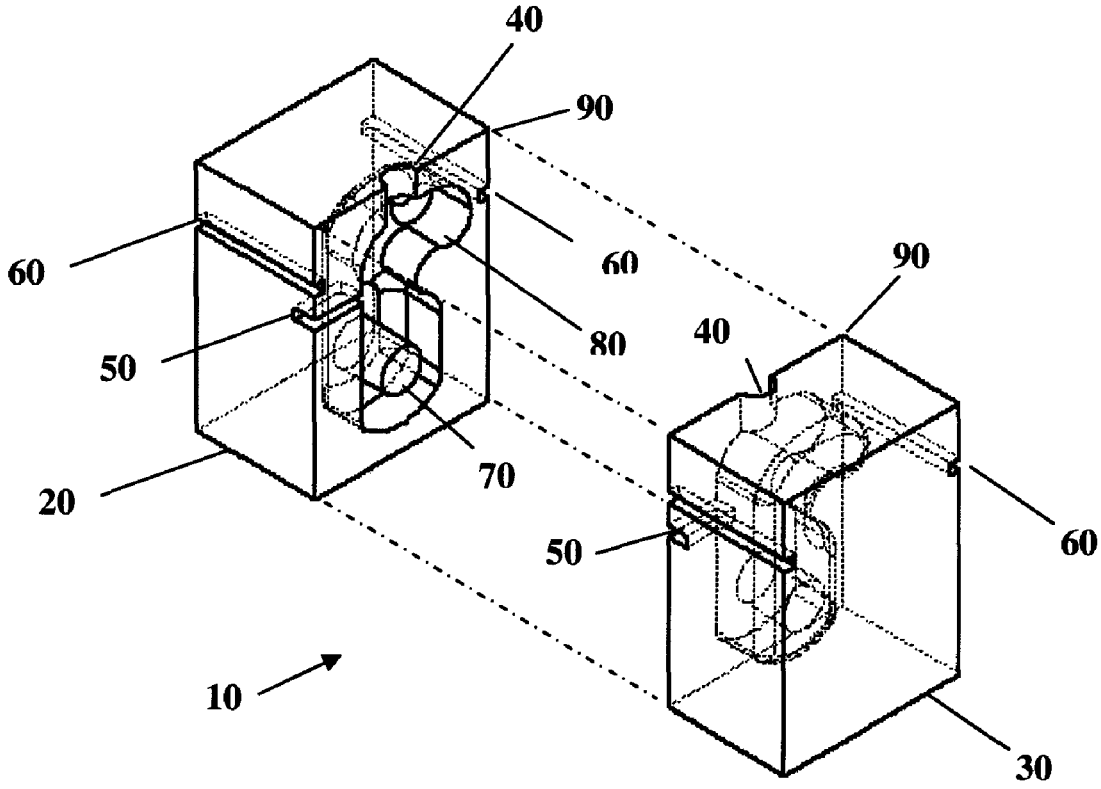
FIG. 2 is a perspective view of one exemplary embodiment of the present invention illustrating core mold assembly unit elements separated across its split line exposing the details of the internal components and features of the assembly.

FIG. 2 further illustrates an example of a core mold assembly unit 10 separated into core mold assembly unit left half 20 and core mold assembly unit right half 30 along a split line 90 to show the internal details of core assembly 70 and mold cavity 80, which in this example, represents the molding features of a railroad car connector knuckle. In one preferred embodiment, the core mold assembly unit 10 is comprised of phenolic urethane treated molding sand, which lends itself to fabrication using the cold-box system known in the art wherein sand may be blown onto replicate patterns of the desired part within individual cope and drag flasks and catalyzed with an amine vapor to enhance its mechanical properties to form relatively durable core mold components 20 and 30 and mold cavity 80 replicating the external features of the part. A core or cores 70, used to replicate the internal features of a part, may be produced using the same method (i.e., cores are made in a core box from phenolic urethane) depending on the need for such as dictated by the part geometry. To reduce effects of pattern wear and consequent irregularity between castings, one embodiment of the invention employs the use of durable cast-iron or steel patterns to replicate the desired geometry and features of part cavity 80 and core or cores 70 within the phenolic urethane treated molding sand during the core mold assembly unit 10 fabrication process. Handling grooves 60 provide a means to easily lift and transport the core mold assembly unit 10. Filling gate 50 provides an entryway for the introduction of molten metal into the core mold assembly unit 10. The riser vent 40 provides for venting of the core mold assembly unit 10 during molten metal insertion.

Figure 3:
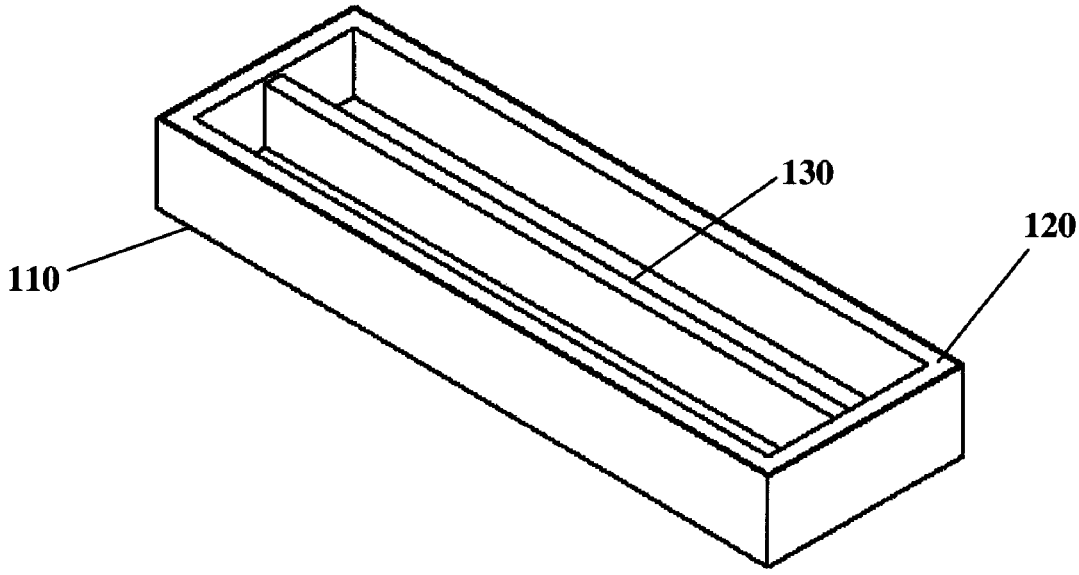
FIG. 3 is a perspective view of one exemplary embodiment of the present invention illustrating the drag.

FIG. 3 illustrates one example of a preferred embodiment wherein an external drag flask 110 is used to contain a plurality of core mold assembly units 10. Drag flask 110 may be made as an external sheet metal weldment or construction of suitable thickness and strength which further comprises a drag liner 120 and drag runner support 130. The drag liner 120 is preferably comprised of a castable refractory as embodied, for example, in commercial ovens and foundry furnaces desired to be durable enough to survive a plurality of casting operations, and is formed and used to constrain and retain core mold assembly units 10 in a closed configuration whereby core mold assembly unit halves 20 and 30 are intimately mated to form a closed molding cavity 80. The drag runner support 130 may be similarly cast as either an integral component of the drag liner 120 or installed as a separate component of the same or different materials.

Figure 4:
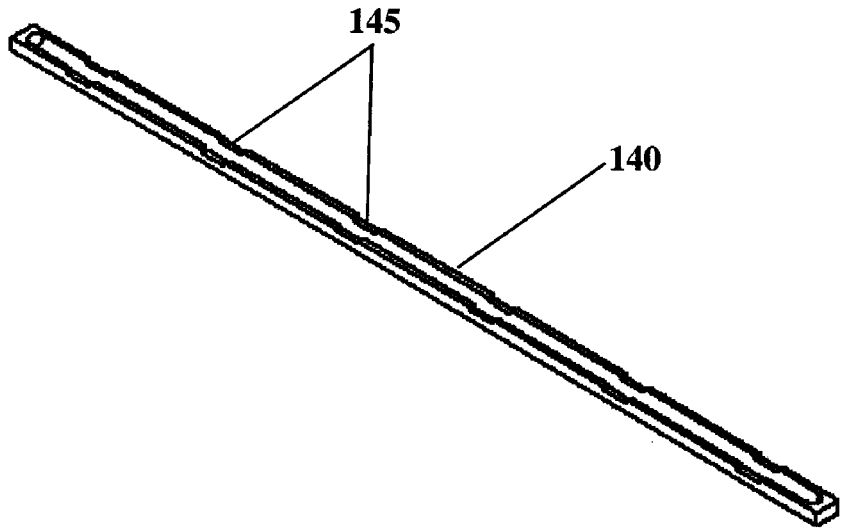
FIG. 4 is a perspective view of one exemplary embodiment of the present invention illustrating the drag runner.

FIG. 4 illustrates one example of a preferred embodiment wherein a drag runner 140 is used to direct molten metal flow to core-mold-units 10 as described below. Drag runner 140 is preferably constructed from phenolic-urethane using the cold-box process and may be constructed either as a single piece or as a plurality of pieces fitted together depending on the capacity of the cold-box system available. A plurality of drag runner gates 145 are symmetrically embodied along the longitudinal axis and are respectively aligned with core mold filling gates 50 to allow the transport of molten metal to each core mold assembly unit from a common sprue filling port, as described in more detail below.

Figure 5:
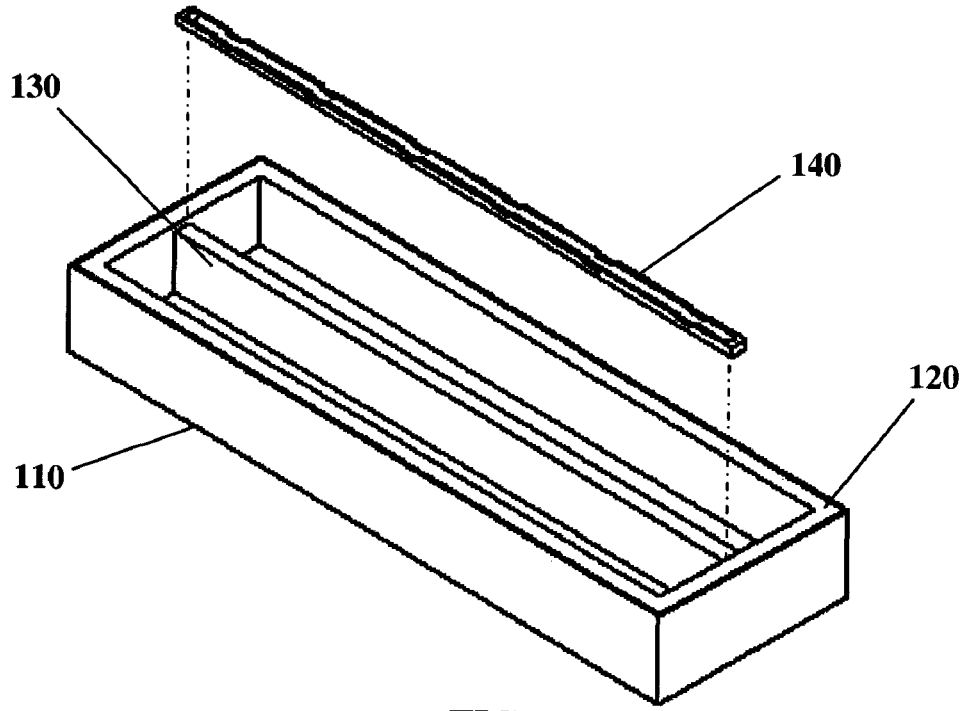
FIG. 5 is an exploded perspective view of one exemplary embodiment of the present invention illustrating the integration of the drag runner with the drag.
Figure 6:
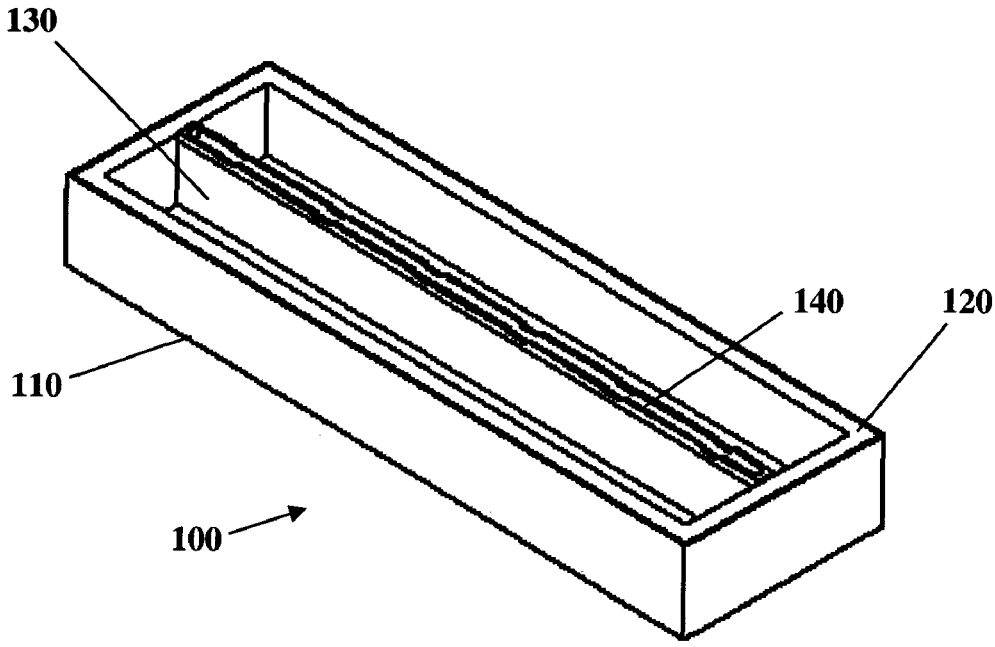
FIG. 6 is a perspective view of one exemplary embodiment of the present invention illustrating an unloaded drag assembly with integrated drag runner and drag.

FIGS. 5 and 6 illustrate one example of a preferred embodiment of the external drag flask assembly 100 showing the relative placement of the drag flask 110, drag flask refractory lining 120, drag runner 140, and drag runner support 130.

Figure 7A:
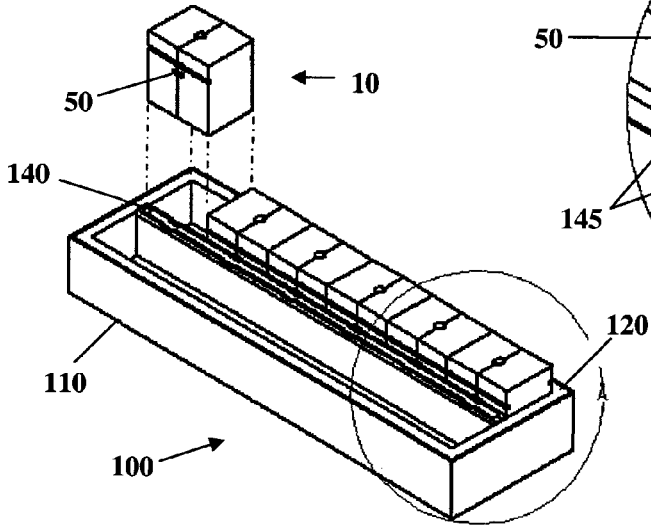
FIG. 7A is a perspective view of one exemplary embodiment of the present invention illustrating the loading configuration of core mold assembly units within the drag assembly.
Figure 7B:
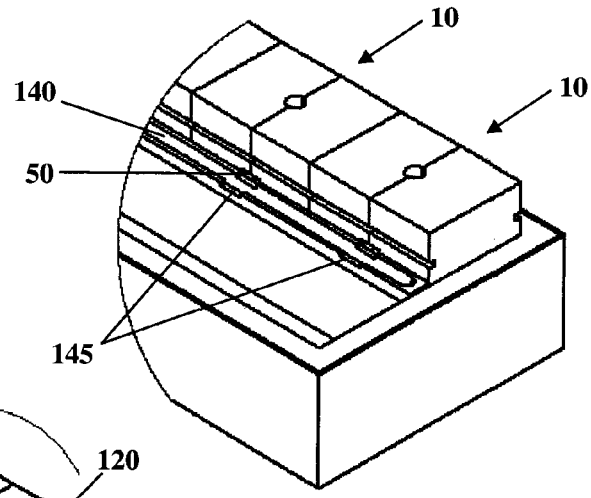
FIG. 7B is a detailed perspective view of one exemplary embodiment of the present invention illustrating alignment of the drag runner gates and core mold filling gates.
Figure 12:
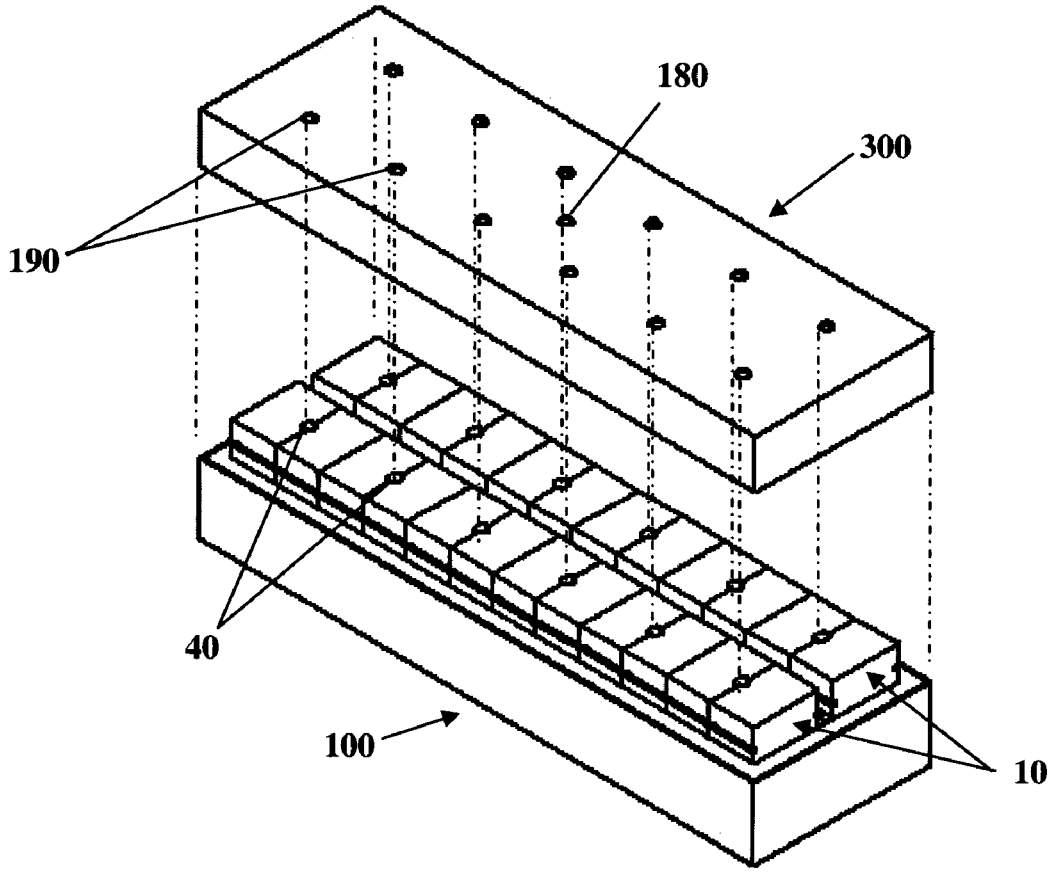
FIG. 12 is an exploded perspective view of one exemplary embodiment of the present invention illustrating the integration of the external cope assembly with the core mold loaded external drag assembly.

FIG. 7A illustrates one example of a preferred loading configuration wherein pluralities of core mold assembly units 10 are loaded within the external drag flask assembly 100. Each core mold assembly unit filling gate 50 on each core mold assembly unit 10 is aligned with its respective drag runner gate 145. FIG. 7B illustrates a detailed view showing the alignment of core-unit filling gates 50 with drag runner gates 145. As shown in FIG. 12, a plurality of core mold assembly units 10 are loaded within the external drag flask assembly 100 and are oriented such that each respective core mold assembly unit filling gate 50 intimately addresses the drag runner 140 and drag runner gates 145 to allow the transport of molten metal to each core mold assembly unit 10.

Figure 8:
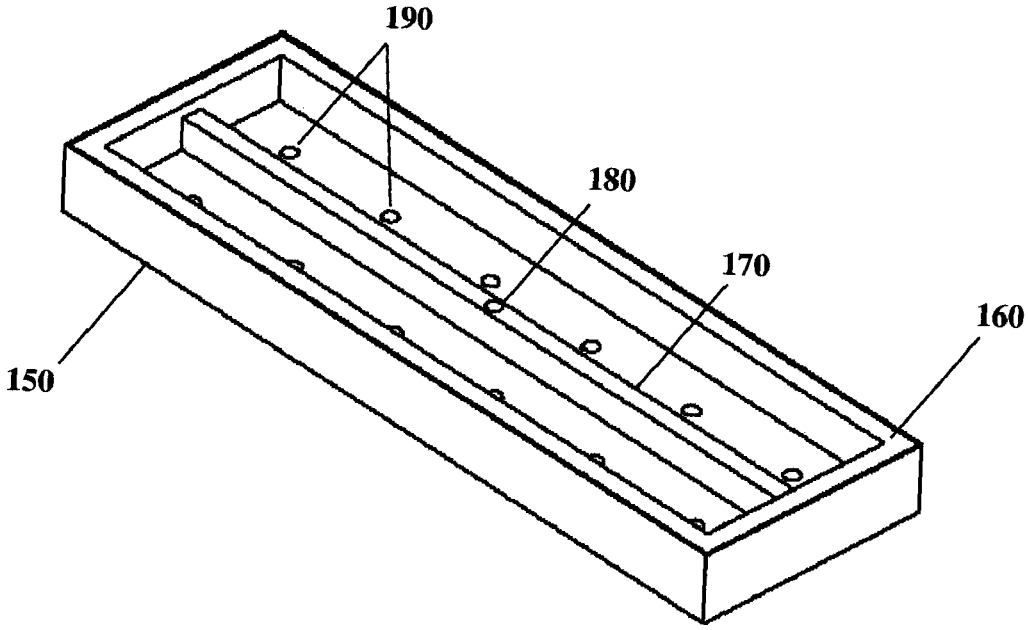
FIG. 8 is a perspective view of one exemplary embodiment of the present invention illustrating the underside of the cope.

FIG. 8 depicts one example of a preferred embodiment of an external cope flask 150, similarly used to contain a plurality of core mold assembly units 10. The external cope flask 150 is preferably made from a sheet metal weldment or construction of suitable thickness and strength which further comprises a cope liner 160 and cope runner support 170. The cope liner 160 is preferably comprised of a castable refractory as embodied, for example, in commercial ovens and foundry furnaces desired to be durable enough to survive a plurality of casting operations. The cope runner support 170 may be similarly cast as either an integral component of the cope liner 160 or installed as a separate component of the same or different materials. Cope riser vent ports 190 are embodied within the cope liner 160 and external cope flask 150 to allow venting and molten metal flow out of the core mold assembly units 10 via core mold riser vents 40.

Figure 9:
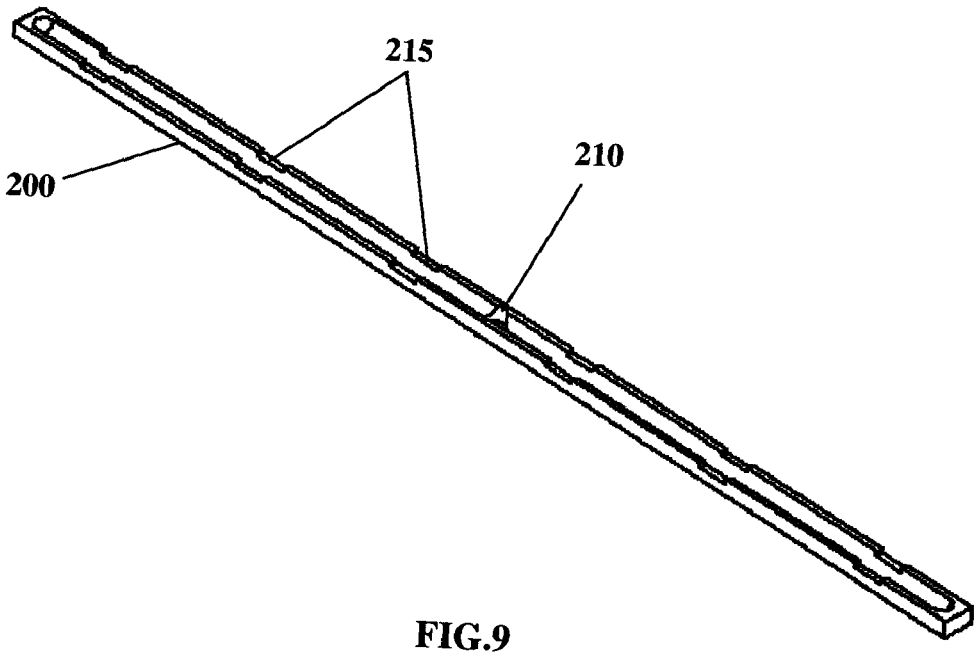
FIG. 9 is a perspective view of one exemplary embodiment of the present invention illustrating the cope runner.

FIG. 9 depicts one example of a preferred embodiment of a cope runner 200, which is preferably constructed similarly to the drag runner 140, from phenolic-urethane using the cold-box process and may be constructed either as a single piece or as a plurality of pieces fitted together depending on the capacity of the cold-box system available. A cope sprue filling port 180, as shown in FIG. 8, is preferably provided to permit the introduction of molten metal into the cope runner 200 via cope runner sprue filling port 210. A plurality of cope runner gates 215 are symmetrically embodied along the longitudinal axis of the cope runner 200 and are respectively aligned with core mold filling gates 50 and drag runner gates 145 to allow the transport of molten metal to each core mold assembly unit 10 from a common cope sprue filling port 180 via cope runner sprue filling port 210 as further illustrated in FIGS. 7, 8 and 9.

Figure 10:
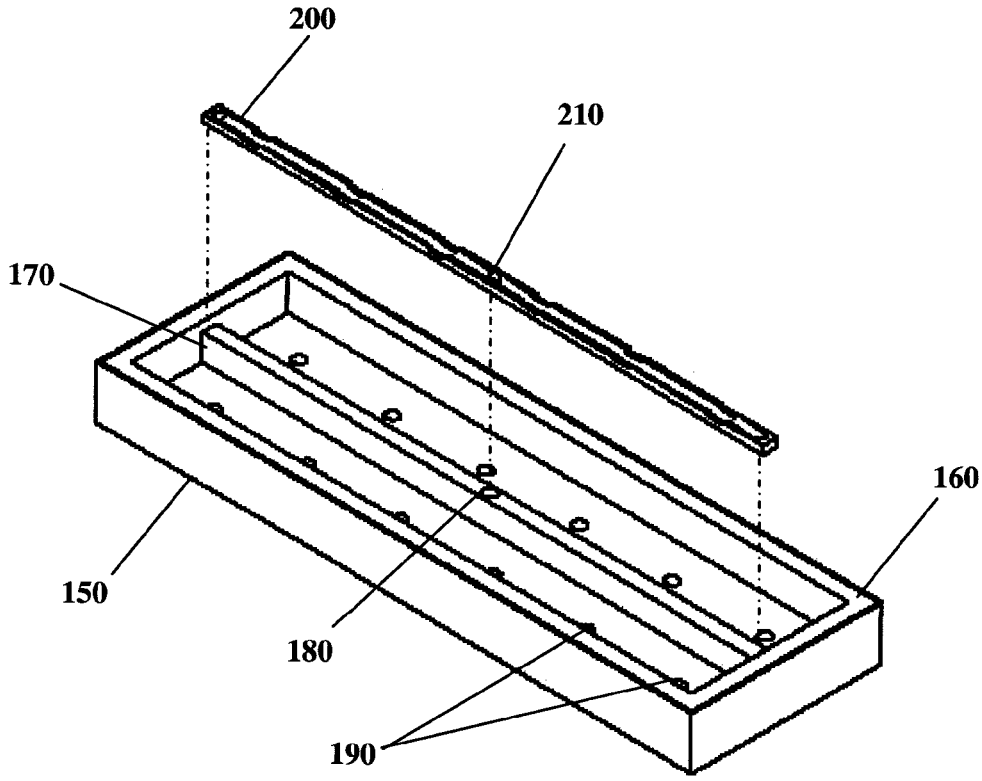
FIG. 10 is an exploded perspective view of one exemplary embodiment of the present invention illustrating the integration of the cope runner with the cope.
Figure 11:
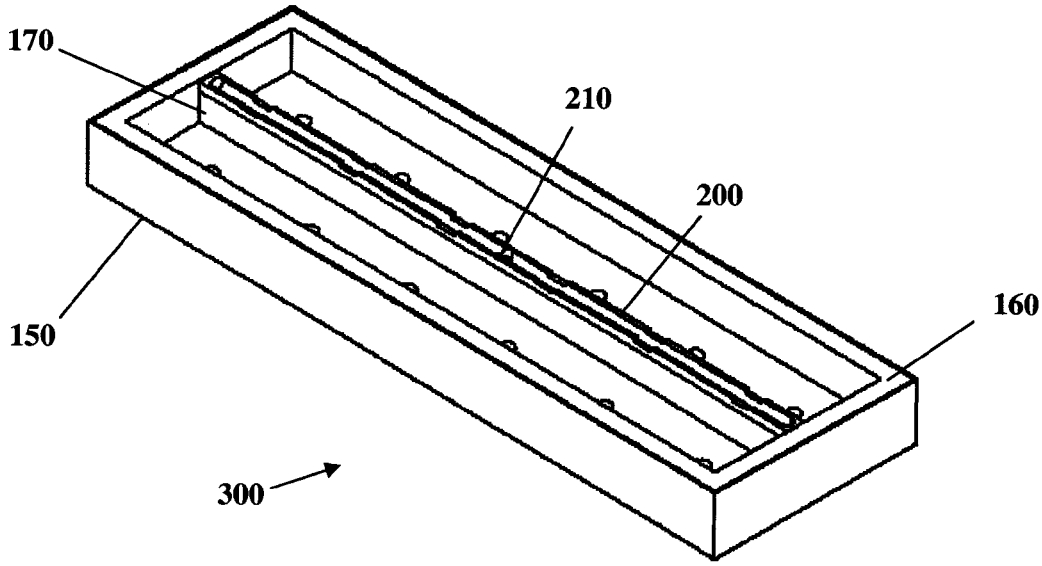
FIG. 11 is a perspective view of one exemplary embodiment of the present invention illustrating an integrated cope runner and cope.

FIGS. 10 and 11 illustrate one example of a preferred embodiment of the external cope flask assembly 300 showing the relative placement of the external cope flask 150, cope lining 160, cope runner 200, and cope runner support 170, cope riser vents 190, and cope sprue filling port 180.

FIG. 12 illustrates one example of a preferred embodiment of a fully loaded external drag assembly 100 wherein the relative position of the external cope assembly 300 is shown in an exploded configuration above the external drag assembly 100 just prior to closure further showing alignment of the cope riser vent ports 190 with core mold riser vents 40.

Figure 13:
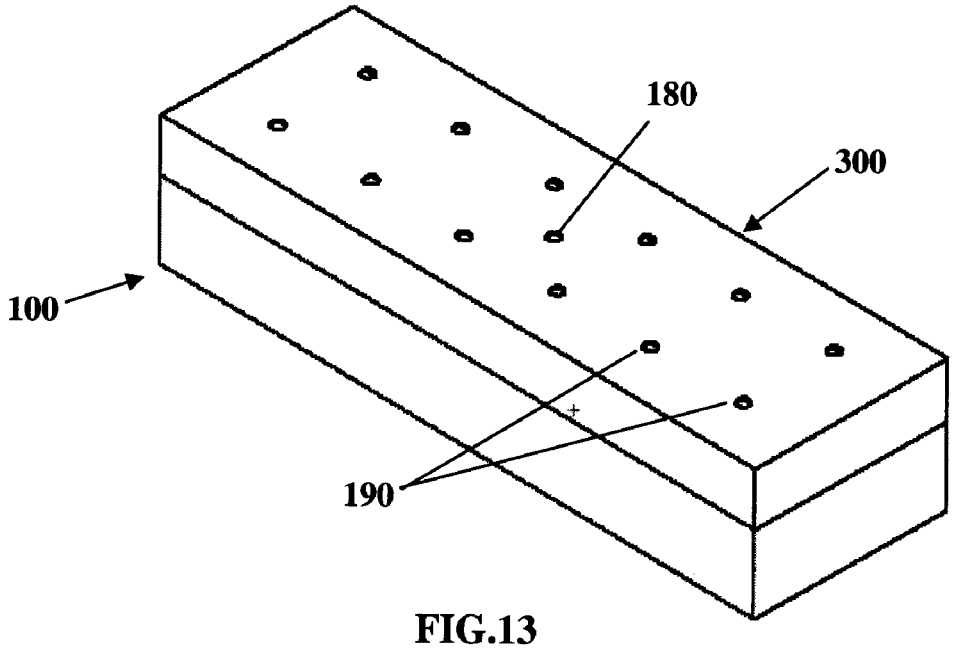
FIG. 13 is a perspective view of one exemplary embodiment of the present invention illustrating an integrated external cope and drag assemblies.

FIG. 13 illustrates one example of a preferred embodiment of a fully loaded external drag assembly 100 wherein the relative position of the external cope assembly 300 is shown in closed configuration conjoined with drag assembly 100 just prior to a casting operation.

During a casting operation, molten metal is poured into the cope sprue filling port 180, as shown in FIG. 13, which subsequently flows to the core mold assembly units 10 via the cope runner sprue filling port 210 and cavity formed by the mated cope runner 200 and drag runner 140. Molten metal exits the cavity formed by the mated cope runner 200 and drag runner 140 via mated drag runner gates 145 and cope runner gates 215 into the core mold filling gates 50 and finally into the core mold assembly unit cavity 80. The pouring of molten metal is typically continued until molten metal is observed to approach or exit the cope riser vents 190 thus ensuring that core mold assembly unit cavities 80 are completely filled to form the desire part.

Figure 14:
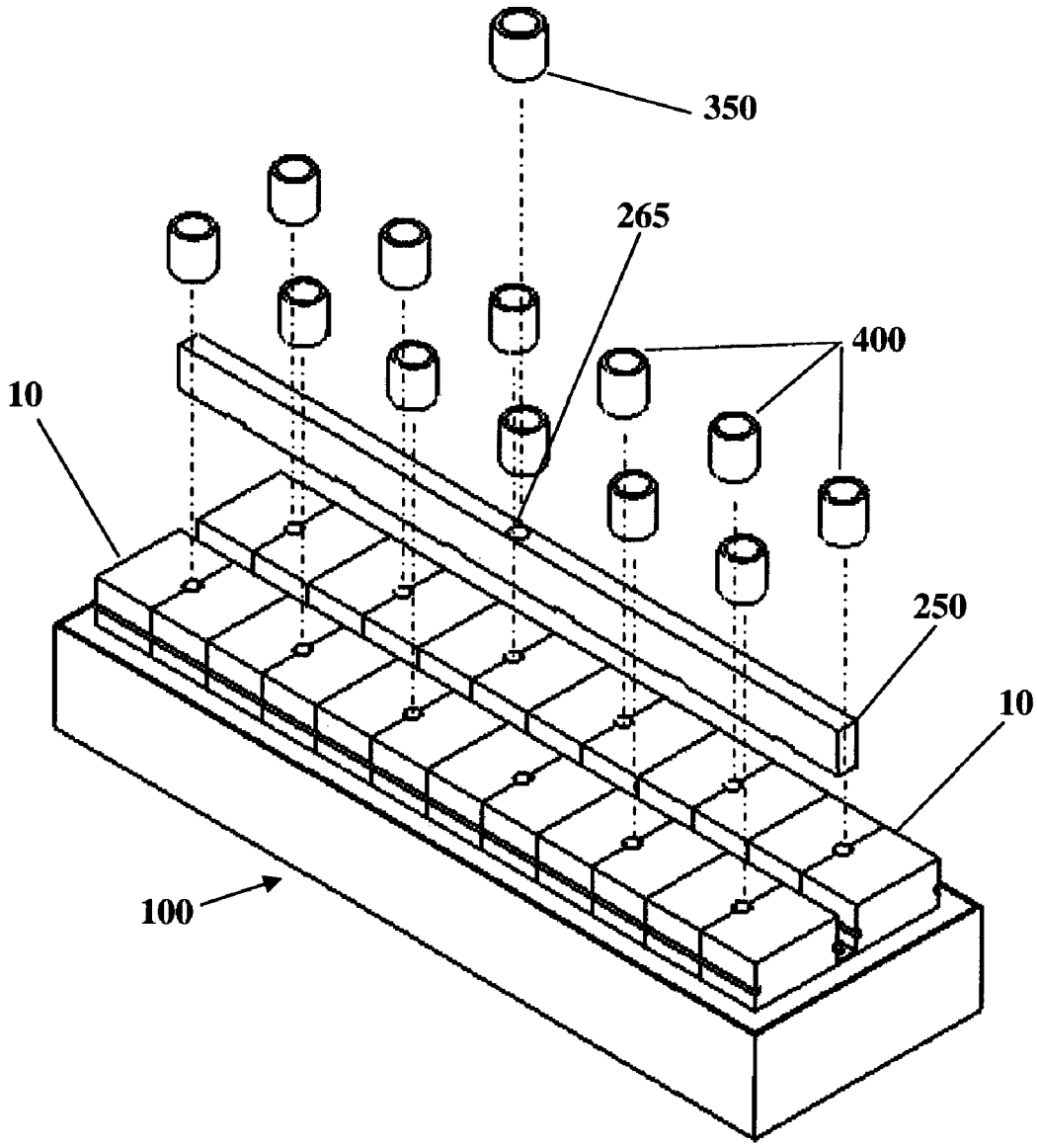
FIG. 14 is an exploded perspective view of one optional exemplary embodiment of the present invention illustrating the replacement of the cope assembly with modified cope runner, core mold riser vent tubes, and core mold filling sprue tube.

FIG. 14 illustrates an exploded view of an alternative example of a preferred embodiment of the present invention wherein the cope assembly 300 is replaced by a modified cope runner 250, at least one core mold filling sprue tube 350, and at least one core mold riser vent tube 400.

Figure 15:
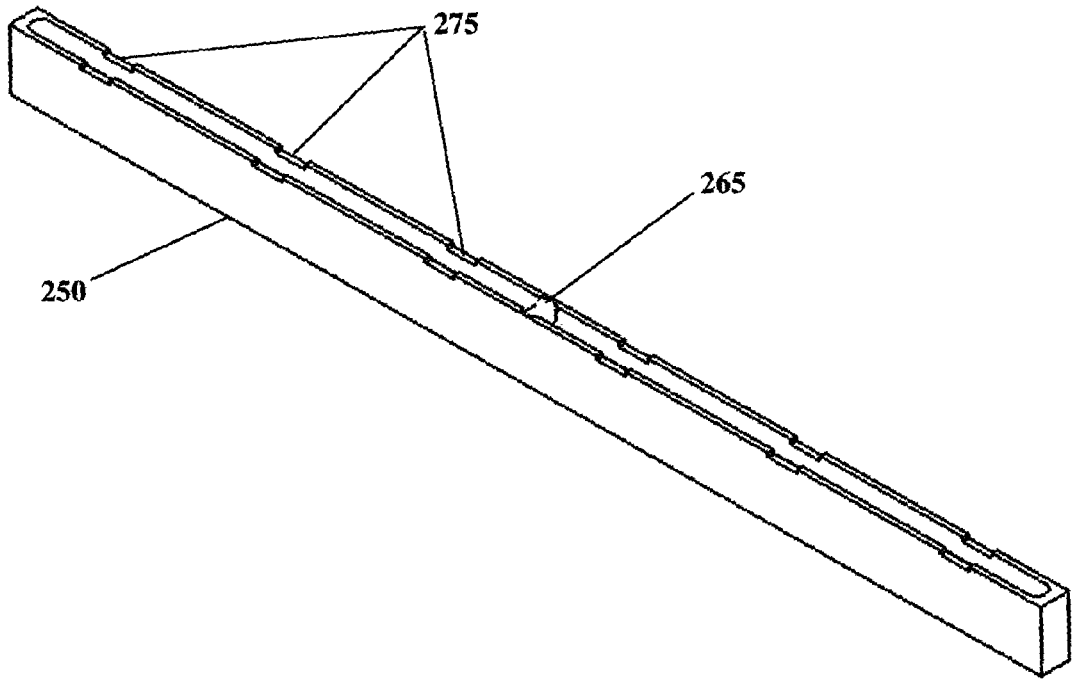
FIG. 15 is a perspective view of one exemplary embodiment of the present invention illustrating a modified cope runner.

FIG. 15 depicts one example of a preferred alternative embodiment of modified cope runner 250, which is preferably constructed similarly to the drag runner 140, from phenolic-urethane using the cold-box process and may be constructed either as a single piece or as a plurality of pieces fitted together depending on the capacity of the cold-box system available. A modified cope runner sprue filling port 265 is provided to permit the introduction of molten metal into the modified cope runner 250 via core mold filling sprue tube 350. A plurality of modified cope runner gates 275 are symmetrically embodied along the longitudinal axis of the modified cope runner 250 and are respectively aligned with core mold filling gates 50 and drag runner gates 145 to allow the transport of molten metal to each core mold assembly unit 10 as similarly described above.

Figure 16:
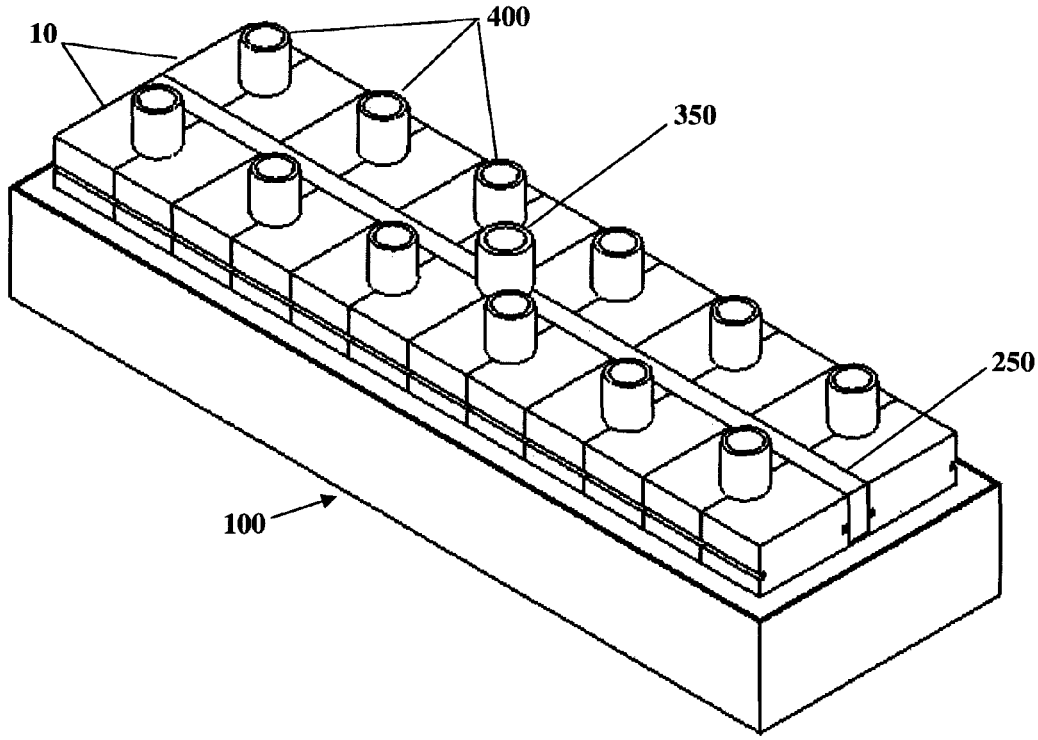
FIG. 16 is a perspective view of one optional exemplary embodiment of the present invention illustrating integrated core mold riser vent tubes, core mold filling sprue tube, modified cope runner, and core mold loaded external drag assembly.
Figure 17:
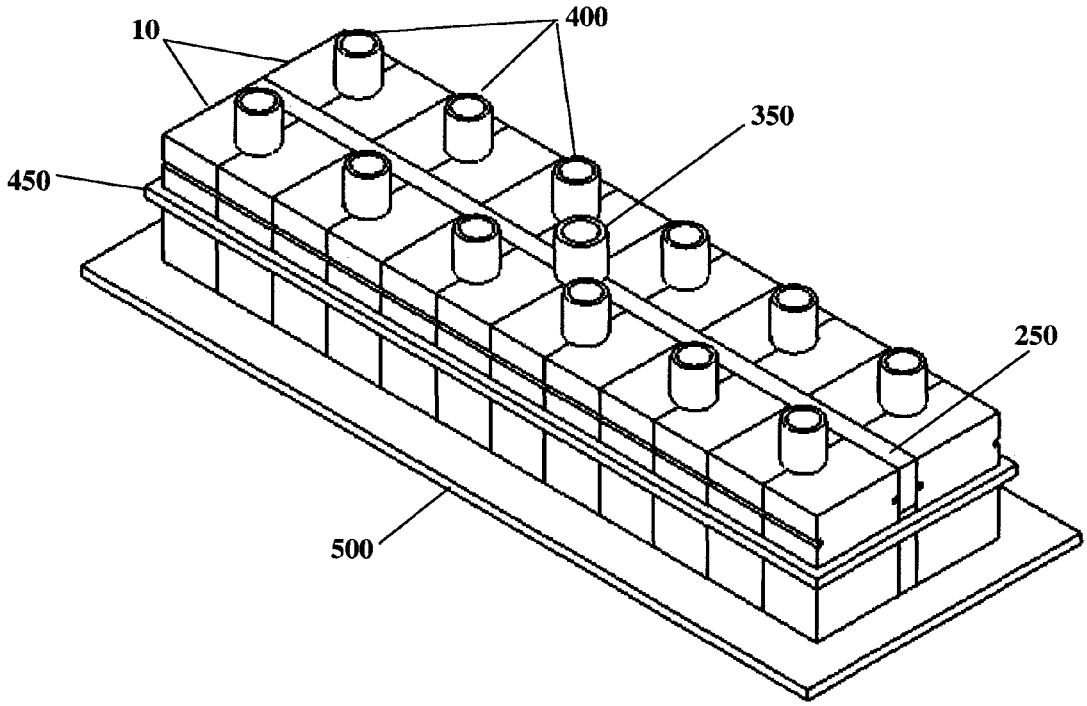
FIG. 17 is a perspective view of one optional exemplary alternative embodiment of the present invention illustrating integrated core mold riser vent tubes, core mold filling sprue tube, modified cope runner, and core mold assembly units constrained by at least one band and supported by a plate.

FIG. 16 illustrates an example of a loaded external drag flask assembly 100 just prior to a casting operation further showing the integrated alternative molding assembly. Although not a limitation and is shown by way of example, a single core mold filling sprue tube 350 may be used to direct molten metal into the modified cope runner 250 via cope runner sprue filling port 265 and subsequently into core mold assembly units 10 to cast a part as similarly described above, wherein each core mold assembly unit 10 is vented by means of at least one core mold riser vent tube 400 placed concentrically about the core mold assembly unit riser vent 40. The core mold riser vent tubes 400 and core mold filling sprue tube 350 may be fixably attached to core mold assembly units 10 and modified cope runner 250 as illustrated by means of a refractory adhesive or bonding agent known to those skilled in the art. It should be furthermore noted that the inventors have discovered that the external drag flask 110 and drag liner 120, as shown in FIG. 3 and embodied within external drag flask assembly 100, may be optionally replaced using, for example, a retaining band or bands 450 that bind the core mold assembly units 10 together with the aforementioned components upon a flat metal plate 500 to provide the integrated alternative molding assembly, as illustrated in FIG. 17, wherein retaining bands 450 may be comprised of metal, plastic, composite materials or combinations thereof.

It should be noted that the description of the invention and method herein is provided as an example and should not be considered limiting or restrictive in any fashion as any number of core mold assembly units and possible casting configurations may be practiced as known to those familiar in the art. This invention thus provides the following advantages not limited to:

- Elimination of the need for pattern gauging;
- Improvement of mold component alignment and reduction of misalignment casting defects;
- Permittance of more aggressive handling of molding components, thereby improving part production rate;
- Improvement of dimensional stability from casing to casting;
- Reduction of finishing costs and scrap rates;
- Simplification of molding and core sand reclamation;
- Reduction of the number of cores needed in some cases; and
- Simplification of a core or core assemblies within the mold cavity.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A casting apparatus for casting parts, comprising a plurality of core mold assembly units configured within an external drag flask assembly and an external cope flask assembly;

wherein said core mold assembly units include at least one riser vent;

at least one filling gate;

mold components formed from molding sand each mated at a common split line defining a mold cavity which replicates the exterior features of said cast parts;

wherein said external drag flask assembly includes a drag flask;

a drag flask lining;

a drag runner; and a drag runner support;

wherein said external cope flask assembly includes a cope flask;

a cope flask lining;

at least one cope riser vent;

at least one cope sprue filling port that allows molten metal to be poured through said cope sprue filling port;

a cope runner which embodies at least one cope runner sprue filling port that allows molten metal to be poured through said cope runner sprue filling port; and a cope runner support.

2. The casting apparatus of claim 1 wherein said core mold assembly units comprise a phenolic urethane treated molding sand.

3. The casting apparatus of claim 1 wherein said drag runner comprises a phenolic urethane treated molding sand.

4. The casting apparatus of claim 1 wherein said cope runner comprises a phenolic urethane treated molding sand.

5. The casting apparatus of claim 1 wherein said drag flask liner comprises a castable refractory.

6. The casting apparatus of claim 1 wherein said cope flask liner comprises a castable refractory.

7. The casting apparatus of claim 1 wherein said drag runner support comprises a castable refractory.

8. The casting apparatus of claim 1 wherein said cope runner support comprises a castable refractory.

9. The casting apparatus of claim 1 wherein said core mold assembly units embody a groove feature to facilitate ease of handling said core mold assembly units.

10. The casting apparatus of claim 1 wherein said cope and drag flasks comprise a sheet metal construction.

11. The casting apparatus of claim 1 wherein said external cope flask assembly comprises:

at least one core mold filling sprue tube;

at least one core mold riser vent tube; and a modified cope runner which embodies at least one cope runner sprue filling port that allows molten metal to be poured through said cope runner sprue filling port.

12. The casting apparatus of claim 1 wherein said external drag flask assembly comprises:

a base plate for supporting a plurality of core mold assembly units;

at least one band surrounding said core mold assembly units;

wherein said band is comprised of materials selected from the group consisting of metals, plastics, and composite materials or combinations thereof.

13. The casting apparatus of claim 1 wherein said core mold assembly unit mold components include at least one core for replicating internal cavity features of said cast parts.

14. A casting method for casting parts providing a plurality of core mold assembly units configured within an external drag flask assembly and an external cope flask assembly, said method comprising:

providing at least one riser vent to allow venting of said core mold assembly unit;

providing at least one filling gate to allow introduction of molten metal into said core mold assembly unit; and providing mold components formed from molding sand each mated at a common split line defining a mold cavity which replicates the exterior features of said cast parts;

wherein said external drag flask assembly includes a drag flask;

a drag flask lining;

a drag runner; and a drag runner support;

wherein said external cope flask assembly includes a cope flask;

a cope flask lining;

at least one cope riser vent;

at least one cope sprue filling port that allows molten metal to be poured through said cope sprue filling port;

a cope runner which embodies at least one cope runner sprue filling port that allows molten metal to be poured through said cope runner sprue filling port;

a cope runner support; and pouring molten metal through said cope sprue filling port, said cope runner sprue filling port, said cope and said drag runners, into said core assembly unit through said core mold assembly unit filling gate thereby filling said core mold assembly unit cavity to cast said parts.

15. The casting method of claim 14 wherein said core mold assembly unit elements comprise a phenolic urethane treated molding sand.

16. The casting method of claim 14 wherein said drag runner comprises a phenolic urethane treated molding sand.

17. The casting method of claim 14 wherein said cope runner comprises a phenolic urethane treated molding sand.

18. The casting method of claim 14 wherein said drag liner comprises a castable refractory.

19. The casting method of claim 14 wherein said cope liner comprises a castable refractory.

20. The casting method of claim 14 wherein said drag runner support comprises a castable refractory.

21. The casting method of claim 14 wherein said cope runner support comprises a castable refractory.

22. The casting method of claim 14 wherein said core mold assembly units embody a groove feature to facilitate ease of handling said core mold assembly units.

23. The casting method of claim 14 wherein said cope and drag flasks comprise a sheet metal construction.

24. The casting method of claim 14 wherein said external cope flask assembly comprises:

at least one core mold filling sprue tube;

at least one core mold riser vent tube; and a modified cope runner which embodies at least one cope runner sprue filling port that allows molten metal to be poured through said cope runner sprue filling port.

* * * * *